US012622540B1

(12) United States Patent
Oh et al.

(10) Patent No.: US 12,622,540 B1
(45) Date of Patent: May 12, 2026

(54) FOLDABLE CLOTHES HANGER

(71) Applicant: Arx Active Pte. Ltd., Singapore (SG)

(72) Inventors: Yong Thye Oh, Singapore (SG); Tze Ming Lee, Singapore (SG); Shaw Pin Letitia Lim, Singapore (SG); Vinh An Hoang, Singapore (SG)

(73) Assignee: Arx Active Pte. Ltd., Singapore (SG)

( * ) Notice: Subject to any disclaimer, the term of this patent is extended or adjusted under 35 U.S.C. 154(b) by 18 days.

(21) Appl. No.: 18/890,825

(22) Filed: Sep. 20, 2024

(51) Int. Cl.
*A47G 25/40* (2006.01)

(52) U.S. Cl.
CPC ..... *A47G 25/4023* (2013.01)

(58) Field of Classification Search
CPC . A47G 25/40; A47G 25/4023; A47G 25/4038
USPC ..... 223/89, 94
See application file for complete search history.

(56) References Cited

U.S. PATENT DOCUMENTS

| | | | | |
|---|---|---|---|---|
| 2,440,637 | A | 4/1948 | Martin | |
| 4,524,890 | A | 6/1985 | Fulton | |
| 7,828,179 | B2 | 11/2010 | Sprovieri | |
| 8,235,261 | B1 | 8/2012 | Park et al. | |
| 8,814,013 | B2 | 8/2014 | Almeida Levi | |
| 9,179,791 | B2 | 11/2015 | Aspera | |
| 10,383,469 | B2 | 8/2019 | Iliev | |
| 11,559,159 | B2 | 1/2023 | Brusilovsky | |
| 11,930,948 | B2 | 3/2024 | Boris | |
| 2006/0054646 | A1 | 3/2006 | Nathanmanna | |
| 2011/0284597 | A1* | 11/2011 | Kaleta | A47G 25/4023 223/85 |
| 2013/0264362 | A1 | 10/2013 | Watanabe | |
| 2017/0325614 | A1 | 11/2017 | Baltz | |
| 2019/0298094 | A1 | 10/2019 | Wright et al. | |

FOREIGN PATENT DOCUMENTS

| | | | | |
|---|---|---|---|---|
| DE | 2107506 | A1 * | 8/1972 | A47G 25/4023 |
| EP | 1817989 | A1 | 8/2007 | |
| KR | 200447741 | Y1 * | 2/2010 | A47G 25/4023 |
| WO | 2011163503 | A2 | 12/2011 | |

* cited by examiner

*Primary Examiner* — Nathan E Durham
(74) *Attorney, Agent, or Firm* — VIERING, JENTSCHURA & PARTNER mbB

(57) ABSTRACT

A foldable clothes hanger including a hub; a first arm rotatably coupled to the hub; a second arm rotatably coupled to the hub; an actuation unit retractably movable with respect to the hub along an extension axis; a hanging hook extending from the hub and non-movable relative to the hub along the extension axis; and a biasing member disposed to bias the actuation unit, wherein the actuation unit comprises a user-actuable portion extended out from the hub when the actuation unit is in an extended position and retractable into the hub when an external force is applied on the user-actuable portion against a biasing force of the biasing member to move the actuation unit to a retracted position, wherein the actuation unit is operatively engaged to the first arm and the second arm to rotate the first arm and the second arm when the actuation unit is moved.

20 Claims, 4 Drawing Sheets

FOLDABLE CLOTHES HANGER

TECHNICAL FIELD

Various embodiments generally relate to a foldable clothes hanger.

BACKGROUND

Conventional clothes hanger generally includes a symmetrical sloped frame with a hanging hook at a top thereof for hanging on a rod or a bar in a clothes storage, e.g. clothes rack or wardrobe. However, when using the conventional clothes hanger with certain types of clothing such as a T-shirt, it may be inconvenient or difficult to insert the conventional clothes hanger into the T-shirt such that the T-shirt can hang from the conventional clothes hanger properly. Most of the time, the user may unintentionally overstretch a neck opening of the T-shirt or overpulled the T-shirt when trying to hang the T-shirt with the conventional clothes hanger. This may result in deformation or tear or distortion in the T-shirt. On the other hand, when using the conventional clothes hanger with clothing having buttoned collar, such as a shirt, the neck opening typically cannot be stretched and the buttoned collar has to be opened for inserting the conventional clothes hanger and closed after the conventional clothes hanger is inserted, which is rather tedious. While there is an alternative of inserting the conventional clothes hanger through the bottom of the clothing, it is more time consuming and cumbersome to do so. Accordingly, there is a need to provide an improved hanger to address some of these issues.

SUMMARY

According to various embodiments, there is provided a foldable clothes hanger. The foldable clothes hanger including a hub; a first arm rotatably coupled to the hub, the first arm being rotatable about a first rotational axis; a second arm rotatably coupled to the hub, the second arm being rotatable about a second rotational axis, wherein the first rotational axis and the second rotational axis are parallel to each other; an actuation unit retractably movable with respect to the hub between a retracted position and an extended position along an extension axis lying in a plane perpendicular to the first rotational axis and the second rotational axis; a hanging hook extending from the hub, the hanging hook being non-movable relative to the hub along the extension axis of the actuation unit; and a biasing member disposed to bias the actuation unit towards the extended position. The actuation unit includes a user-actuable portion extended out from the hub when the actuation unit is in the extended position and retractable into the hub when an external force is applied on the user-actuable portion against a biasing force of the biasing member to move the actuation unit to the retracted position. The actuation unit is operatively engaged to the first arm and the second arm to rotate the first arm and the second arm away from each other into an opened state when the actuation unit is moved from the retracted position to the extended position and to rotate the first arm and the second arm towards each other into the closed state when the actuation unit is moved from the extended position to the retracted position.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments are described with reference to the following drawings, in which.

DETAILED DESCRIPTION

Embodiments described below in the context of the apparatus are analogously valid for the respective methods, and vice versa. Furthermore, it will be understood that the embodiments described below may be combined, for example, a part of one embodiment may be combined with a part of another embodiment.

It should be understood that the terms "on", "over", "top", "bottom", "down", "side", "back", "left", "right", "front", "lateral", "side", "up", "down" etc., when used in the following description are used for convenience and to aid understanding of relative positions or directions, and not intended to limit the orientation of any device, or structure or any part of any device or structure. In addition, the singular terms "a", "an", and "the" include plural references unless context clearly indicates otherwise. Similarly, the word "or" is intended to include "and" unless the context clearly indicates otherwise.

Various embodiments generally relate to a foldable clothes hanger. In various embodiments, the foldable clothes hanger may be normally in an opened state. In the opened state, the foldable clothes hanger may serve to support a clothing draped over the foldable clothes hanger in a manner similar to that of the conventional clothes hanger. However, according to various embodiments, the foldable clothes hanger may be temporary folded into a closed state for case of insertion into a clothing and be subsequently unfolded into the opened state to support the clothing so as to facilitate case of hanging the clothing. According to various embodiments, the foldable clothes hanger may be configured for single-handed operation to fold the foldable clothes hanger from the opened state into the closed state such that a user may hold the clothing in one hand and the foldable clothes hanger in the other hand when inserting the foldable clothes hanger into the clothing for hanging the clothing. According to various embodiments, the foldable clothes hanger may be ergonomically configured for holding in the user's hand and folding from the opened state into the closed state using simple movement of fingers, such as closing of fingers together.

Figure 1:
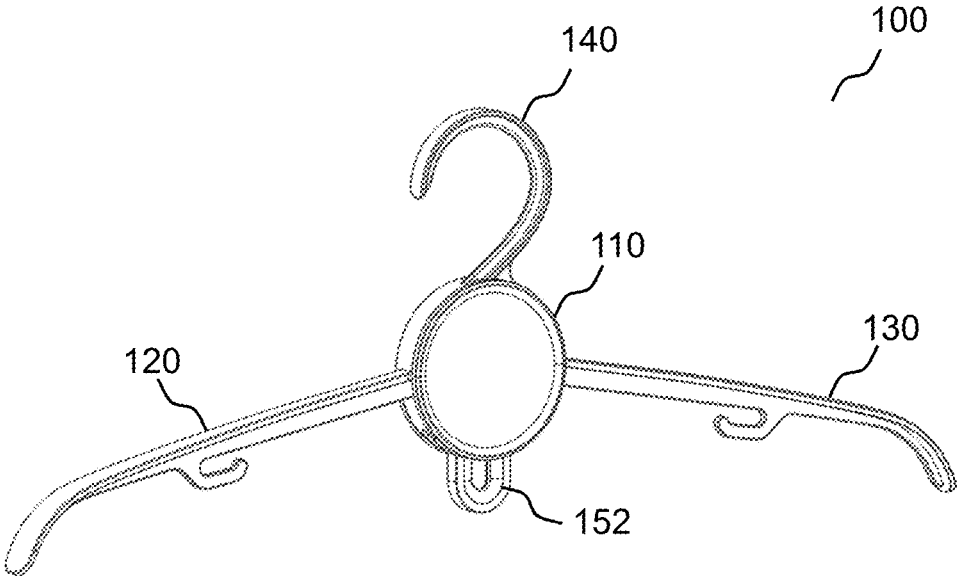
FIG. 1 shows a perspective view of a foldable clothes hanger in an opened state according to various embodiments.
Figure 2:
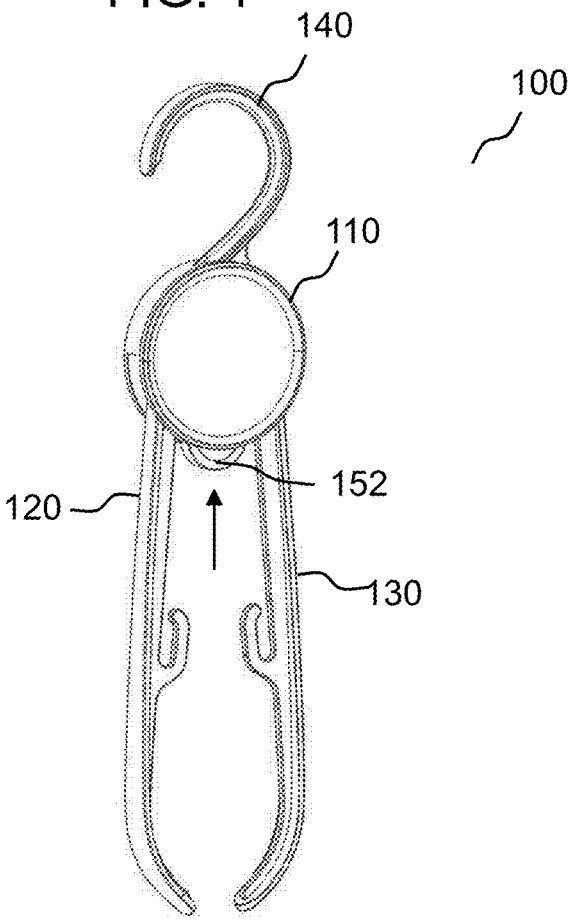
FIG. 2 shows a perspective view of the foldable clothes hanger of FIG. 1 folded into a closed state according to various embodiments.
Figure 3:
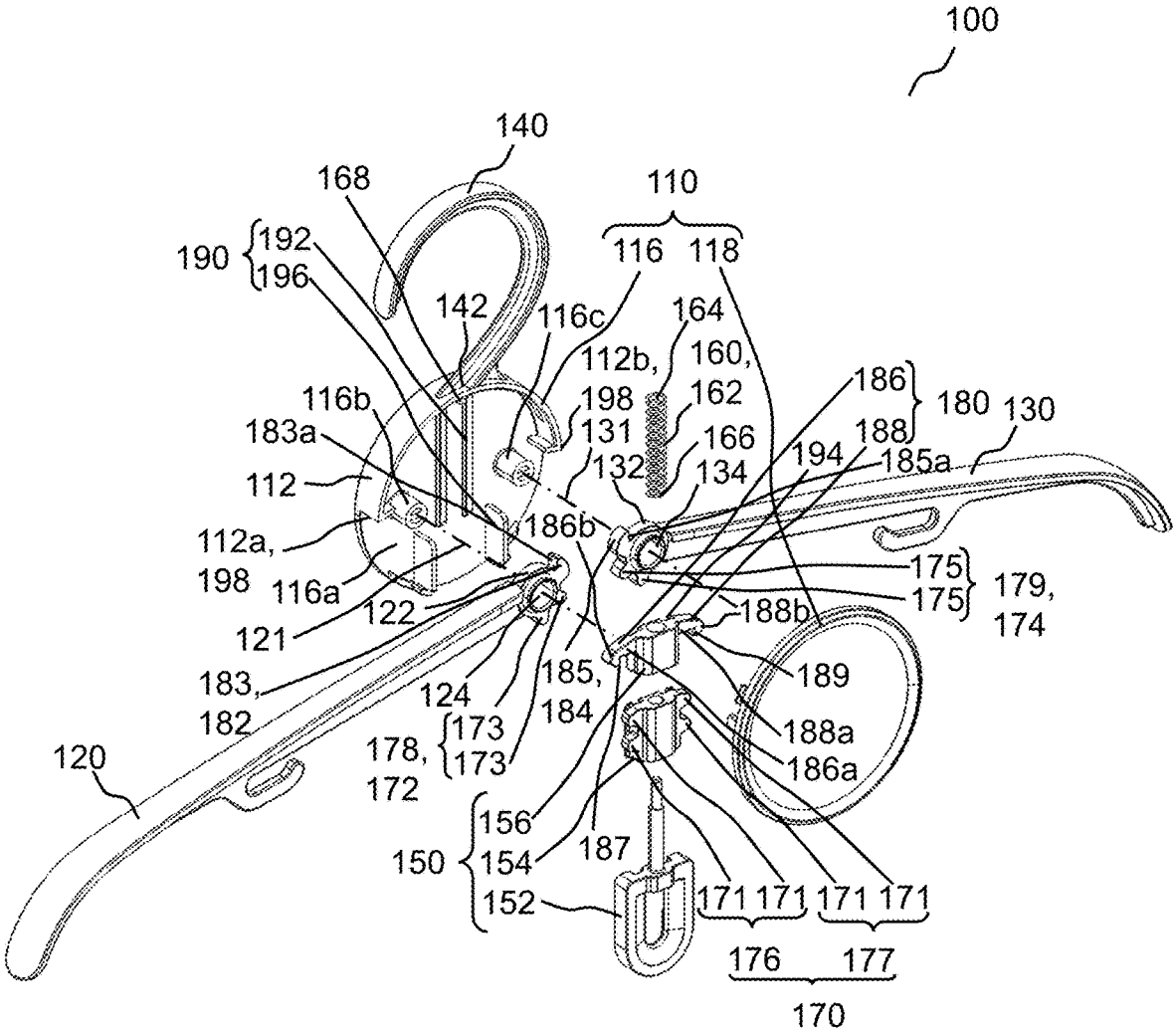
FIG. 3 shows an exploded view of the foldable clothes hanger of FIG. 1 according to various embodiments.
Figure 4:
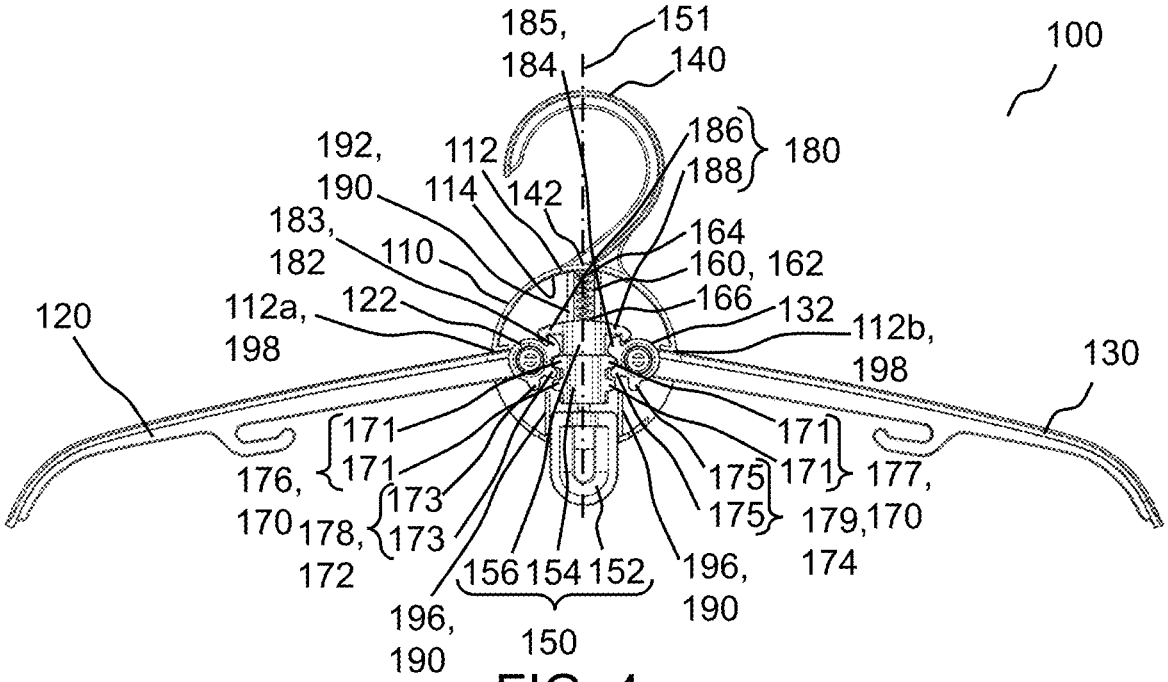
FIG. 4 shows a cross sectional view of the foldable clothes hanger of FIG. 1 in the opened state according to various embodiments.
Figure 5:
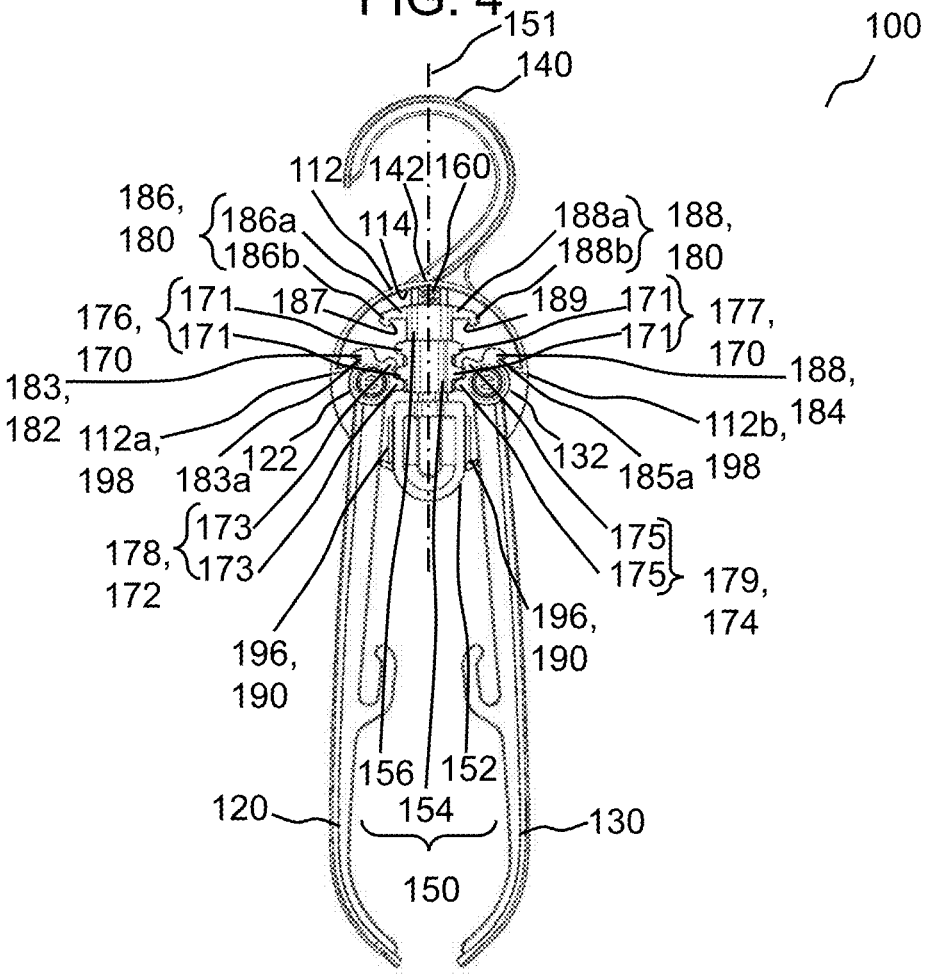
FIG. 5 shows a cross sectional view of the foldable clothes hanger of FIG. 1 in the closed state according to various embodiments.

FIG. 1 shows a perspective view of a foldable clothes hanger 100 in an opened state according to various embodiments. FIG. 2 shows a perspective view of the foldable clothes hanger 100 of FIG. 1 folded into a closed state according to various embodiments. FIG. 3 shows an exploded view of the foldable clothes hanger 100 of FIG. 1 according to various embodiments. FIG. 4 shows a cross sectional view of the foldable clothes hanger 100 of FIG. 1 in the opened state according to various embodiments. FIG. 5 shows a cross sectional view of the foldable clothes hanger 100 of FIG. 1 in the closed state according to various embodiments.

According to various embodiments, the foldable clothes hanger 100 may include a hub 110. The hub 110 may be a central part of the foldable clothes hanger 100. According to various embodiments, the hub 110 may be of a box-like structure having a shape including, but not limited to, a flat cylinder, a cuboid, a prism, an ovoid, a sphere, or a hemisphere. The box-like structure of the hub 110 may define an interior space. The interior space may accommodate components and/or mechanism of the foldable clothes hanger 100. According to various embodiments, the foldable clothes hanger 100 may include a first arm 120 and a second arm 130. Each of the first arm 120 and the second arm 130 may extend from the hub 110 of the foldable clothes hanger 100. For example, each of the first arm 120 and the second arm 130 may extend from within the interior space of the hub 110 to outside the hub 110. According to various embodiments, each of the first arm 120 and the second arm 130 may be in the form of, including but not limited to, a bar, a rod, a boom, or a pole. According to various embodiments, the first arm 120 and the second arm 130 may have a same length and may be extending in a symmetrical manner with respect to a centerline of the hub 110.

According to various embodiments, when the foldable clothes hanger 100 is in the opened state (e.g. as shown in FIG. 1), the first arm 120 and the second arm 130 may form an obtuse angle about the hub 110. The obtuse angle may be less than 180° and more than 90°.

Accordingly, the first arm 120 and the second arm 130 may extend in a divergent manner from the hub 110 so as to be sloping from two opposite sides of the hub 110. Thus, the first arm 120 and the second arm 130 may form an isosceles configuration with respect to the hub 110. According to various embodiments, when the foldable clothes hanger 100 is in the closed state (e.g. as shown in FIG. 2), the first arm 120 and the second arm 130 may extend from the hub 110 in a substantially parallel manner or in an almost parallel manner (e.g. forming an angle equal to or less than) 10°. Further, in the closed state, the first arm 120 and the second arm 130 may be extending in a same direction from the hub 110 and may be side-by-side (or alongside each other).

According to various embodiments, the foldable clothes hanger 100 may include a hanging hook 140. The hanging hook 140 may be extending from the hub 110. According to various embodiments, the hanging hook 140 may be a slender structure that extends away from the hub 110 and curves backwards towards the hub 110 to form the hook. According to various embodiments, the hanging hook 140 may extend from a perimeter of the hub 110, whereby the hanging hook 140 may be at a mid-point along the perimeter of the hub 110 between the first arm 120 and the second arm 130. When the foldable clothes hanger 100 is in the opened state (e.g. as shown in FIG. 1), the hanging hook 140 may be extending from a side of the hub 110 opposite the obtuse angle formed between the first arm 120 and the second arm 130. When the foldable clothes hanger 100 is in the closed state (e.g. as shown in FIG. 2), the hanging hook 140 may be extending from the hub 110 in a direction opposite the first arm 120 and the second arm 130 (or away from the first arm 120 and the second arm 130). According to various embodiments, the hanging hook 140, the first arm 120 and the second arm 130 may be extending from the hub 110 in a manner so as to be lying in a same plane.

According to various embodiments, the first arm 120 may be rotatably coupled to the hub 110. Accordingly, the first arm 120 may be rotatable relative to the hub 110. Further, the first arm 120 may be rotatable about a first rotational axis 121. According to various embodiments, the second arm 130 may be rotatably coupled to the hub 110. Accordingly, the second arm 130 may be rotatable relative to the hub 110. Further, the second arm 130 may be rotatable about a second rotational axis 131. With the first arm 120 and the second arm 130 being rotatable relative to the hub 110, the first arm 120 and the second arm 130 may be rotated away from each other such that the foldable clothes hanger 100 may be in the opened state. Further, the first arm 120 and the second arm 130 may be rotated towards each other such that the foldable clothes hanger 100 may be in the closed state. According to various embodiments, the first rotational axis 121 of the first arm 120 and the second rotational axis 131 of the second arm 130 may be parallel to each other. According to various embodiments, the first arm 120 and the second arm 130 may be rotated in a synchronous manner.

Referring to FIG. 4 and FIG. 5, according to various embodiments, the foldable clothes hanger 100 may include an actuation unit 150. The actuation unit 150 may be configured for controlling the rotation of the first arm 120 and the second arm 130 relative to the hub 110. According to various embodiments, the actuation unit 150 may be retractably movable with respect to the hub 110 between a retracted position (as shown in FIG. 5) and an extended position (as shown in FIG. 4) along an extension axis 151. Accordingly, the actuation unit 150 may be moved along the extension axis 151, whereby the retracted position and the extended position may be different positions along the extension axis 151. According to various embodiments, moving the actuation unit 150 along the extension axis 151 between the retracted position and the extended position may correspondingly rotate the first arm 120 and the second arm 130 for moving the first arm 120 and the second arm 130 into the opened state or the closed state. According to some embodiments, the extension axis 151 of the actuation unit 150 may coincide with the centerline of the hub 110. According to various embodiments, the actuation unit 150 may be an elongated structure having a longitudinal axis. The longitudinal axis of the elongated structure may be parallel or coincide with the extension axis 151 of the actuation unit 150. Accordingly, the actuation unit 150 may be movable longitudinally along the longitudinal axis of the elongated structure of the actuation unit 150. Hence, the elongated structure of the actuation unit 150 may be a plunger-like structure retractably movable longitudinally with respect to the hub 110 between the retracted position and the extended position. For example, the elongated structure of the actuation unit 150 may be insertable into the hub 110 and extendable out from the hub 110 in a manner similar to a plunger. According to some embodiments, the actuation unit 150 may be a one-piece elongated structure. According to some embodiments, the actuation unit 150 may be two or more pieces coupled or connected or joined together to form the elongated structure. Regardless, the actuation unit 150 may be moved as a single unit relative to the hub 110.

According to various embodiments, the extension axis 151 of the actuation unit 150 may lie in a plane perpendicular to the first rotational axis 121 of the first arm 120 and the second rotational axis 131 of the second arm 130. Accordingly, the actuation unit 150 may be moved in the plane perpendicular to the first rotational axis 121 of the first arm 120 and the second rotational axis 131 of the second arm 130. According to various embodiments, the actuation unit 150, the first arm 120 and the second arm 130 may lie in the plane perpendicular to the first rotational axis 121 of the first arm 120 and the second rotational axis 131 of the second arm 130. Accordingly, each of the first arm 120 and the second arm 130 may be respectively rotated along the plane perpendicular to the first rotational axis 121 of the first arm 120 and the second rotational axis 131 of the second arm 130, and about the first rotational axis 121 and the second rotational axis 131 respectively.

According to various embodiments, the hanging hook 140 may be non-movable relative to the hub 110 along the extension axis 151 of the actuation unit 150. Accordingly, a position of the hanging hook 140 along the extension axis 151 with respect to a position of the hub 110 along the extension axis 151 may remain fixed regardless of whether the actuation unit 150 is moved to the retracted position along the extension axis 151 or the extended position along the extension axis 151. Hence, the hanging hook 140 may be free of relative movement with respect to the hub 110 in either direction along the extension axis 151 of the actuation unit 150.

According to various embodiments, the foldable clothes hanger 100 may include a biasing member 160. The biasing member 160 may be disposed to bias the actuation unit 150 towards the extended position. Accordingly, the biasing member 160 may apply a biasing force to urge the actuation unit 150 towards the extended position such that the actuation unit 150 may normally be in the extended position. Hence, in the absence of any external forces or additional forces acting on the actuation unit 150, the biasing member 160 may keep or maintain the actuation unit 150 in the extended position. According to various embodiments, the biasing member 160 may include, but not limited to, a spring or a resilient element. According to some embodiments, the spring may include, but not limited to, a compression spring, an extension spring, a torsion spring, or a spiral spring. According to some embodiments, the resilient element may include, but not limited to, rubber block or a silicone block.

According to various embodiments, the actuation unit 150 may include a user-actuable portion 152. The user-actuable portion 152 may serve as a user interface for the user to actuate the actuation unit 150 for controlling the rotation of the first arm 120 and the second arm 130. According to various embodiments, when the actuation unit 150 is in the form of the elongated structure, the user-actuable portion 152 may be a first longitudinal end portion of the elongated structure. According to various embodiments, when the actuation unit 150 is in the extended position, the user-actuable portion 152 may be extended out from the hub 110. Accordingly, the user-actuable portion 152 may be protruding or protracting from the hub 110. With the user-actuable portion 152 extended out from the hub 110, the user may easily access or reach the user-actuable portion 152. As shown, according to various embodiments, the user-actuable portion 152 may be in the form of a tab or a tongue whereby a fingertip may press against an edge thereof. Further, the user may also pinch the tab or the tongue from both sides of the tab or the tongue. In the example shown, the tab or the tongue may have a rounded flat shape, such as a semi-circular shape.

According to various embodiments, the user may apply an external force on the user-actuable portion 152 against the biasing force of the biasing member 160 to retract the user-actuable portion 152 into the hub 110 so as to move the actuation unit 150 from the extended position to the retracted position. For example, the user may apply the external force by depressing the user-actuable portion 152 to push the user-actuable portion 152 into the hub 110. Accordingly, the user-actuable portion 152 of the actuation unit 150 may be retractable into the hub 110 when the external force is applied on the user-actuable portion 152 against the biasing force of the biasing member 160 to move the actuation unit 150 to the retracted position. Hence, the user may actuate the actuation unit 150 to control the rotation of the first arm 120 and the second arm 130 by applying the external force to retract the user-actuable portion 152 into the hub 110 for moving the actuation unit 150 to the retracted position.

According to various embodiments, after the user has applied the external force to retract the user-actuable portion 152 into the hub 110, the user may reverse the rotation of the first arm 120 and the second arm 130 by releasing the external force such that the biasing force of the biasing member 160 may move the actuation unit 150 back to the extended position. Accordingly, with the external force removed, the biasing member 160 may apply the biasing force on the actuation unit 150 to move the actuation unit 150 from the retracted position to the extended position to rotate the first arm 120 and the second arm 130 back to the initial disposition (e.g. the opened state). Hence, the user may control the first arm 120 and the second arm 130 to rotate back to the initial disposition by removing the external force so that the biasing member 160 may bias the actuation unit 150 to move the actuation unit 150 back to the extended position.

According to various embodiments, the actuation unit 150 may be operatively engaged to the first arm 120 and the second arm 120. Accordingly, the actuation unit 150, the first arm 120 and the second arm 120 may be arranged to work such that the actuation unit 150 may operate the first arm 120 and the second arm 120 to rotate when the actuation unit 150 is being moved. According to various embodiments, with the actuation unit 150 operatively engaged to the first arm 120 and the second arm 120, the actuation unit 150 may operate the first arm 120 and the second arm 130 to rotate away from each other such that the first arm 120 and the second arm 130 may move into the opened state when the actuation unit 150 is moved from the retracted position to the extended position. According to various embodiments, with the actuation unit 150 operatively engaged to the first arm 120 and the second arm 120, the actuation unit 150 may operate the first arm 120 and the second arm 130 to rotate the first arm 120 and the second arm 130 towards each other such that the first arm 120 and the second arm 130 may move into the closed state when the actuation unit 150 is moved from the extended position to the retracted position. Accordingly, the first arm 120 and the second arm 130 may be in the opened state when the actuation unit 150 is in the extended position, and the first arm 120 and the second arm 130 may be in the closed state when the actuation unit 150 is in the retracted position. By depressing the user-actuable portion 152 of the actuation unit 150 to push the user-actuable portion 152 into the hub 110, the actuation unit 150 may be moved from the extended position to the retracted position so as to move the first arm 120 and the second arm 130 into the closed state. Further, by releasing the external force depressing the user-actuable portion 152 of the actuation unit 150, the biasing member 160 may urge the actuation unit 150 to move from the retracted position to the extended position so as to move the first arm 120 and the second arm 130 into the opened state.

According to various embodiments, the actuation unit 150 may be operatively engaged to the first arm 120 and the second arm 120 to rotate the first arm 120 and the second arm 120 in a synchronous manner. Accordingly, moving the actuation unit 150 along the extension axis 151 may simultaneously rotate the first arm 120 and the second arm 120. For example, moving the actuation unit 150 from the extended position to the retracted position may simultaneously rotate the first arm 120 and the second arm 130 towards each other such that the first arm 120 and the second arm 130 may move into the closed state. Further, moving the actuation unit 150 from the retracted position to the extended position may simultaneously rotate the first arm 120 and the second arm 130 away from each other such that the first arm 120 and the second arm 130 may move into the opened state.

According to various embodiments, when the actuation unit 150 is in the extended position with the user-actuable portion 152 of the actuation unit 150 extended out of the hub 110, the user-actuable portion 152 of the actuation unit 150 and the hanging hook 140 may be respectively at opposite sides of the hub 110. Accordingly, the user-actuable portion 152 of the actuation unit 150 may extend out of the hub 110 in a direction opposite and away from the hanging hook 140. Hence, the user-actuable portion 152 of the actuation unit 150 may be extending away from the hanging hook 140.

According to various embodiments, the hanging hook 140 may extend from the hub 110 with a base 142 of the hanging hook 140 intersecting the extension axis 151 of the actuation unit 150. Further, the user-actuable portion 152 of the actuation unit 150 may be extended out of the hub 110 in a direction away from the hanging hook 140 along the extension axis 151 of the actuation unit 150 when the actuation unit 150 is in the extended position. Accordingly, the user-actuable portion 152 of the actuation unit 150 and the base of the hanging hook 140 may be at opposite sides of the hub 110 along the extension axis 151 of the actuation unit 150.

According to various embodiments, since the hanging hook 140 is non-movable relative to the hub 110 along the extension axis 151 of the actuation unit 150, the actuation unit 150 being movable relative to the hub 110 along the extension axis 151 may also be movable relative to the hanging hook 140 along the extension axis 151. Accordingly, the actuation unit 150 may be moved towards the hanging hook 140 when the actuation unit 150 is moved from the extended position to the retracted position, and the actuation unit 150 may be moved away from the hanging hook 140 when the actuation unit 150 is moved from the retracted position to the extended position.

According to various embodiments, the actuation unit 150 may include an arm actuation portion 154. According to various embodiments, when the actuation unit 150 is in the form of the elongated structure, the arm actuation portion 154 may be a mid-portion of the elongated structure, i.e. a middle segment lengthwise of the elongated structure. According to various embodiments, the arm actuation portion 154 of the actuation unit 150 may include an engagement arrangement 170. According to various embodiments, the first arm 120 may include a corresponding engagement arrangement 172 at a longitudinal end portion 122 of the first arm 120. According to various embodiments, the second arm 130 may include a corresponding engagement arrangement 174 at a longitudinal end portion 132 of the second arm 130. According to various embodiments, the engagement arrangement 170 of the arm actuation portion 154 may be in engagement with the corresponding engagement arrangement 172 at the longitudinal end portion 122 of the first arm 120 and the corresponding engagement arrangement 174 at the longitudinal end portion 132 of the second arm 130. The engagement between the engagement arrangement 170 of the arm actuation portion 154 and the corresponding engagement arrangements 172, 174 respectively at the longitudinal end portion 122 of the first arm 120 and at the longitudinal end portion 132 of the second arm 130 may allow the actuation unit 150 to operate the first arm 120 and the second arm 120 so as to rotate the first arm 120 and the second arm 120 when the actuation unit 150 is being moved. According to various embodiments, the engagement arrangement 170 of the arm actuation portion 154 of the actuation unit 150 may be engaged with the corresponding engagement arrangements 172, 174 respectively at the longitudinal end portion 122 of the first arm 120 and at the longitudinal end portion 132 of the second arm 130 in a manner so as to rotate the first arm 120 and the second arm 130 in the synchronous manner when the actuation unit 150 is moved along the extension axis 151.

According to various embodiments, the first rotational axis 121 of the first arm 120 may extend through the longitudinal end portion 122 of the first arm 120. Accordingly, the arm actuation portion 154 of the actuation unit 150 may actuate or drive the first arm 120 to rotate about the first rotational axis 121 via the engagement between the engagement arrangement 170 of the arm actuation portion 154 and the corresponding engagement arrangement 172 at the longitudinal end portion 122 of the first arm 120. According to various embodiments, the second rotational axis 131 of the second arm 130 may extend through the longitudinal end portion 132 of the second arm 130. Accordingly, the arm actuation portion 154 of the actuation unit 150 may actuate or drive the second arm 130 to rotate about the second rotational axis 131 via the engagement between the engagement arrangement 170 of the arm actuation portion 154 and the corresponding engagement arrangement 174 at the longitudinal end portion 132 of the second arm 130.

According to various embodiments, the engagement between the engagement arrangement 170 of the arm actuation portion 154 and the corresponding engagement arrangements 172, 174 respectively at the longitudinal end portion 122 of the first arm 120 and at the longitudinal end portion 132 of the second arm 130 may convert a linear motion of the arm actuation portion 154 of the actuation unit 150 along the extension axis 151 into rotating motions of the first arm 120 and the second arm 130 about the first rotational axis 121 and the second rotational axis 131 respectively. Thus, the engagement therebetween may serve as linear to rotary motion converter, whereby the arm actuation portion 154 of the actuation unit 150 may provide an input motion (e.g. the linear motion) and output motions (e.g. the rotation motions) may be resulted in the first arm 120 and the second arm 130. According to various embodiments, the engagement between the engagement arrangement 170 of the arm actuation portion 154 and the corresponding engagement arrangements 172, 174 respectively at the longitudinal end portion 122 of the first arm 120 and at the longitudinal end portion 132 of the second arm 130 may allow a single input motion (e.g. the linear motion) to result in simultaneous output motions (e.g. the rotation motions) exhibited by the first arm 120 and the second arm 130.

According to various embodiments, the engagement between the engagement arrangement 170 of the arm actuation portion 154 and the corresponding engagement arrangements 172, 174 respectively at the longitudinal end portion 122 of the first arm 120 and at the longitudinal end portion 132 of the second arm 130 may include, but not limited to, a rack and pinion type engagement or a crank and slider type engagement or a belt and pulley type engagement.

As illustrated in FIG. 4 and FIG. 5, the engagement between the engagement arrangement 170 of the arm actuation portion 154 and the corresponding engagement arrangements 172, 174 respectively at the longitudinal end portion 122 of the first arm 120 and at the longitudinal end portion 132 of the second arm 130 may be the rack and pinion type engagement. According to various embodiments, the engagement arrangement 170 of the arm actuation portion 154 of the actuation unit 150 may include two rows 176, 177 of teeth 171, i.e. a first row 176 and a second row 177. Each row (i.e. the first row 176 and the second row 177) may be parallel to the extension axis 151 of the actuation unit 150. The first row 176 of teeth 171 and the second row 177 of teeth 171 may be parallel to each other and may be along opposite sides of the arm actuation portion 154 across the extension axis 151 of the arm actuation portion 154. For example, when the actuation unit 150 is in the form of the elongated structure, the first row 176 of teeth 171 and the second row 177 of teeth 171 may be along to opposite longitudinal sides of the elongated structure. Further, the teeth 171 between the two rows 176, 177 of teeth 171 (i.e. the first row 176 and the second row 177) may be directed in opposite directions. Accordingly, the teeth 171 of the first row 176 and the teeth 171 of the second row 177 may be extending perpendicularly with respect to the extension axis 151 and in opposite directions away from each other.

According to various embodiments, the corresponding engagement arrangement 172, 174 at each of the longitudinal end portion 122 of the first arm 120 and the longitudinal end portion 132 of the second arm 130 may include a set 178, 179 of arcuately arranged teeth 173, 175. Accordingly, the teeth 173 at the longitudinal end portion 122 of the first arm 120 may be arranged in the arcuate or curve manner to form the set 178 of arcuately arranged teeth 173. Similarly, the teeth 175 at the longitudinal end portion 132 of the second arm 130 may be arranged in the arcuate or curve manner to form the set 179 of arcuately arrangement teeth 175. Further, the set 178 of arcuately arranged teeth 173 at the longitudinal end portion 122 of the first arm 120 and the set 179 of arcuately arranged teeth 175 at the longitudinal end portion 132 of the second arm 130 may mirror each other across the extension axis 151 of the arm actuation portion 154 (e.g. the extension axis 151 may serve as an axis of symmetry).

According to various embodiments, the set 178 of arcuately arranged teeth 173 at the longitudinal end portion 122 of the first arm 120 may be in engagement with the first row 176 of teeth 171 of the arm actuation portion 154 of the actuation unit 150, and the set 179 of arcuately arranged teeth 175 at the longitudinal end portion 132 of the second arm 130 may be in engagement with the second row 177 of teeth 171 of the arm actuation portion 154 of the actuation unit 150. Accordingly, when the arm actuation portion 154 of the actuation unit 150 is moved along the extension axis 151, the first row 176 of teeth 171 of the arm actuation portion 154 may move together with the arm actuation portion 154. Since the first row 176 of teeth 171 of the arm actuation portion 154 is meshed with the set 178 of arcuately arranged teeth 173 at the longitudinal end portion 122 of the first arm 120, the first row 176 of teeth 171 of the arm actuation portion 154 may transmit a motion of the arm actuation portion 154 to the set 178 of arcuately arranged teeth 173 at the longitudinal end portion 122 of the first arm 120 causing the first arm 120 to rotate about the first rotational axis 121 extending through the longitudinal end portion 122 of the first arm 120. Similarly, since the second row 177 of teeth 171 of the arm actuation portion 154 is meshed with the set 179 of arcuately arranged teeth 175 at the longitudinal end portion 132 of the second arm 130, the second row 177 of teeth 171 of the arm actuation portion 154 may transmit a motion of the arm actuation portion 154 to the set 179 of arcuately arranged teeth 175 at the longitudinal end portion 132 of the second arm 130 causing the second arm 130 to rotate about the second rotational axis 131 extending through the longitudinal end portion 132 of the second arm 130.

Referring to FIG. 4 and FIG. 5, in an example, each row 176, 177 of teeth 171 of the arm actuation portion 154 of the actuation unit 150 may include two teeth 171. Accordingly, the first row 176 of teeth 171 of the arm actuation portion 154 may include two teeth 171 arranged in a straight line, and the second row 177 of teeth 171 of the arm actuation portion 154 may include two teeth 171 arranged in a straight line. It is understood that in various examples, each row 176, 177 of teeth 171 of the arm actuation portion 154 of the actuation unit 150 may include three or four or five or more teeth 171. Further, in the example, the set 178, 179 of arcuately arranged teeth 173, 175 at each of the longitudinal end portion 121 of the first arm 120 and the longitudinal end portion 131 of the second arm 130 may include two teeth. Accordingly, the set 178 of arcuately arranged teeth 173 at the longitudinal end portion 122 of the first arm 120 may include two teeth arranged along a curved or arc segment at the longitudinal end portion 122 of the first arm 120, and the set 179 of arcuately arranged teeth 175 at the longitudinal end portion 132 of the second arm 130 may include two teeth arranged along a curved or arc segment at the longitudinal end portion 132 of the second arm 130. It is also understood that in various examples, the set 178, 179 of arcuately arranged teeth 173, 175 at each of the longitudinal end portion 121 of the first arm 120 and the longitudinal end portion 131 of the second arm 130 may include three or four or five or more teeth.

According to various embodiments, the actuation unit 150 may include an arm locking portion 156. According to various embodiments, when the actuation unit 150 is in the form of the elongated structure, the arm locking portion 156 may be at a second longitudinal end portion of the elongated structure opposite the user-actuable portion 152 of the actuation unit 150. According to various embodiments, the arm locking portion 156 of the actuation unit 150 may include an interlocking arrangement 180. According to various embodiments, the first arm 120 may include a corresponding interlocking arrangement 182 at the longitudinal end portion 122 of the first arm 120. According to various embodiments, the second arm 130 may include a corresponding engagement arrangement 184 at the longitudinal end portion 132 of the second arm 130. According to various embodiments, the interlocking arrangement 180 of the arm locking portion 156 of the actuation unit 150 may be interlockable with the corresponding interlocking arrangement 182 at the longitudinal end portion 122 of the first arm 120 and the corresponding interlocking arrangement 184 of the longitudinal end portion 132 of the second arm 130. Accordingly, the interlocking arrangement 180 of the arm locking portion 156 of the actuation unit 150 may interlock with the corresponding interlocking arrangements 182, 184 respectively at longitudinal end portion 122 of the first arm 120 and the longitudinal end portion 132 of the second arm 130 so as to lock the first arm 120 and the second arm 130 from rotating. Thus, the interlocking arrangement 180 of the arm locking portion 156 of the actuation unit 150 may serve to lock the first arm 120 and the second arm 130 in place in order to prevent the first arm 120 and the second arm 130 from rotating.

According to various embodiments, the arm locking portion 156 of the actuation unit 150 may lock the first arm 120 and the second arm 130 in the opened state when the actuation unit 150 is in the extended position. When the first arm 120 and the second arm 130 are in the opened state, a clothing may be draped over the first arm 120 and the second arm 130. Hence, the first arm 120 and the second arm 130 may be required to support a weight of the clothing such that the foldable clothes hanger 100 may be used by the user to hang up the clothing. With the arm locking portion 156 of the actuation unit 150 locking the first arm 120 and the second arm 130 in the opened state, the arm locking portion 156 of the actuation unit 150 may prevent the weight of the clothing from weighing down the first arm 120 and the second arm 130 to cause unintentional folding of the first arm 120 and the second arm 130 towards each other.

According to various embodiments, the arm locking portion 156 of the actuation unit 150 and the biasing member 160 may cooperatively work together to lock the first arm 120 and the second arm 130 in place when the actuation unit 150 is in the extended position with the first arm 120 and the second arm 130 in the opened state. The biasing force of the biasing member 160 may urge the actuation unit 150 towards the extended position whereby, in the extended position, the interlocking arrangement 180 of the arm locking portion 156 of the actuation unit 150 may interlock with the corresponding interlocking arrangement 182 at the longitudinal end portion 122 of the first arm 120 and the corresponding interlocking arrangement 184 of the longitudinal end portion 132 of the second arm 130. Accordingly, the biasing member 160 may move the actuation unit 150 such that the arm locking portion 156 of the actuation unit 150 may be moved into interlocking the interlocking arrangement 180 of the arm locking portion 156 of the actuation unit 150 with the corresponding interlocking arrangements 182, 184 respectively at longitudinal end portion 122 of the first arm 120 and the longitudinal end portion 132 of the second arm 130. According to various embodiments, the biasing member 160 may be pre-loaded. Accordingly, when the actuation unit 150 is in the extended position, the biasing member 160 may continue to apply the biasing force to keep the actuation unit 150 in the extended position. Thus, with the biasing member 160 pre-loaded, the biasing member 160 may continue to urge the arm locking portion 156 of the actuation unit 150 to lock the first arm 120 and the second arm 130 in place so as to maintain the first arm 120 and the second arm 130 in the opened state.

According to various embodiments, the arm locking portion 156 of the actuation unit 150 may unlock the first arm 120 and the second arm 130 for rotating into the closed state when the actuation unit 150 is moved from the extended position towards the retracted position. Accordingly, moving the actuation unit 150 out of the extended position (e.g. towards the retracted position) may move the arm locking portion 156 of the actuation unit 150 to unlock the first arm 120 and the second arm 130. For example, the actuation unit 150 may be moved such that the interlocking arrangement 180 of the arm locking portion 156 of the actuation unit 150 may separate or set apart from the corresponding interlocking arrangements 182, 184 respectively at longitudinal end portion 122 of the first arm 120 and the longitudinal end portion 132 of the second arm 130 so as to unlock the first arm 120 and the second arm 130. With the arm locking portion 156 of the actuation unit 150 unlocked from the first arm 120 and the second arm 130, the first arm 120 and the second arm 130 may be rotated by the arm actuation portion 154 of the actuation unit 150 about the first rotational axis 121 and the second rotational axis 131 respectively.

According to various embodiments, the interlocking arrangement 180 of the arm locking portion 156 of the actuation unit 150 may include a pair of locking hooks 186, 188 (e.g. a first locking hook 186 and a second locking hook 188). The pair of locking hooks 186, 188 may be extending in opposite directions. Further, each of the locking hooks 186, 188 may be extending in a direction perpendicular to the extension axis 151 of the actuation unit 150. Accordingly, the pair of locking hooks 186, 188 may extend from two opposites of the actuation unit 150. Further, the pair of locking hooks 186, 188 may mirror each other across the extension axis 151 of the actuation unit 150 (which may serve as an axis of symmetry)

According to various embodiments, the corresponding interlocking arrangement 182, 184 at each of the longitudinal end portion 122 of the first arm 120 and the longitudinal end portion 132 of the second arm 130 may include a locking tooth 183, 185. Accordingly, the corresponding interlocking arrangement 182 at the longitudinal end portion 122 of the first arm 120 may include the locking tooth 183, and the corresponding interlocking arrangement 184 at the longitudinal end portion 132 of the second arm 130 may include the locking tooth 185. According to various embodiments, the locking tooth 183 at the longitudinal end portion 122 of the first arm 120 may be adjacent a last tooth 173 of the set 178 of arcuately arranged teeth 173 at the longitudinal end portion 122 of the first arm 120. Similarly, the locking tooth 185 at the longitudinal end portion 132 of the second arm 130 may be adjacent a last tooth 175 of the set 179 of arcuately arranged teeth 175 at the longitudinal end portion 132 of the second arm 130. Accordingly, the locking tooth 183 and the set 178 of arcuately arranged teeth 173 may be lined or distributed along an arcuate or curve side of the longitudinal end portion 122 of the first arm 120, and the locking tooth 185 and the set 179 of arcuately arranged teeth 175 may be lined or distributed along an arcuate or curve side of the longitudinal end portion 132 of the second arm 130.

According to various embodiments, when the arm locking portion 156 of the actuation unit 150 locks the first arm 120 and the second arm 130, the first locking hook 186 of the arm locking portion 156 of the actuation unit 150 may interlock with the locking tooth 183 of the first arm 120 and the second locking hook 188 of the arm locking portion 156 of the actuation unit 150 may interlock with the locking tooth 185 of the second arm 130. Accordingly, when the arm locking portion 156 of the actuation unit 150 is at the extended position, the first locking hook 186 of the arm locking portion 156 of the actuation unit 150 may fit over the locking tooth 183 of the first arm 120 to prevent the first arm 120 from rotating, and the second locking hook 188 of the arm locking portion 156 of the actuation unit 150 may fit over the locking tooth 185 of the second arm 120 to prevent the second arm 130 from rotating. Thus, the interlocking of the first locking hook 186 of the arm locking portion 156 with the locking tooth 183 of the first arm 120 may impede rotation of the first arm 120. Similarly, the interlocking of the second locking hook 188 of the arm locking portion 156 with the locking tooth 185 of the second arm 130 may impede rotation of the second arm 130.

According to various embodiments, each of the pair of locking hooks 186, 188 of the arm locking portion 156 of the actuation unit 150 may include a locking surface 187, 189 parallel to the extension axis 151 of the actuation unit 150. Accordingly, the locking surface 187 of the first locking hook 186 of the arm locking portion 156 and the locking surface 189 of the second locking hook 188 of the arm locking portion 156 may be parallel to the extension axis 151 of the actuation unit 150. According to some embodiments, for example as shown, each locking hook 186, 188 may include a shank portion 186*a*, 188*a* and a jaw portion 186*b*, 188*b*. The shank portions 186*a*, 188*a* of the pair of locking hooks 186, 188 may be extending from the actuation unit 150 in a direction substantially perpendicular to the extension axis 151 of the actuation unit 150 and away from each other. The jaw portion 186*b*, 188*b* of each locking hook 186, 188 may be extending substantially perpendicularly from the respective shank portion 186*a*, 188*a*. Hence, the jaw portion 186*b*, 188*b* of each locking hook 186, 188 may be extending substantially parallel to the extension axis 151 of the actuation unit 150. The locking surface 187 of the first locking hook 186 may be at the jaw portion 186*b* of the first locking hook 186. Similarly, the locking surface 189 of the second locking hook 188 may be at the jaw portion 188*b* of the second locking hook 188.

According to various embodiments, the locking surfaces 187, 189 of the pair of locking hooks 186, 188 of the arm locking portion 156 of the actuation unit 150 may be directed towards each other and parallel to each other. Accordingly, the locking surface 187 of the first locking hook 186 and the locking surface 189 of the second locking hook 188 may be inward facing, for example towards the extension axis 151 of the actuation unit 150, such that the locking surfaces 187, 189 of the pair of locking hooks 186, 188 may be directed towards each other. Further, the locking surface 187 of the first locking hook 186 and the locking surface 189 of the second locking hook 188 may be aligned to be parallel to each other.

According to various embodiments, the locking tooth 183, 185 at each of the longitudinal end portion 122 of the first arm 120 and the longitudinal end portion 132 of the second arm 130 may include a corresponding locking surface 183*a*, 185*a* oriented parallel to the extension axis 151 of the actuation unit 150 when the first arm 120 and the second arm 130 are in the opened state. Accordingly, when the first arm 120 and the second arm 130 are rotated into the opened state, the locking tooth 183 at the longitudinal end portion 122 of the first arm 120 may be correspondingly rotated such that the corresponding locking surface 183*a* of the locking tooth 183 may be oriented parallel to the extension axis 151 of the actuation unit 150, and the locking tooth 185 at the longitudinal end portion 132 of the second arm 130 may be correspondingly rotated such that the corresponding locking surface 185*a* of the locking tooth 185 may be oriented parallel to the extension axis 151 of the actuation unit 150. On the other hand, the corresponding locking surface 183*a*, 185*a* of the locking tooth 183, 185 at each of the longitudinal end portion 122 of the first arm 120 and the longitudinal end portion 132 of the second arm 130 may be non-parallel with the extension axis 151 of the actuation unit 150 when the first arm 120 and the second arm 130 are in the closed state.

According to various embodiments, when the arm locking portion 156 of the actuation unit 150 locks the first arm 120 and the second arm 130, the locking surface 187 of the first locking hook 186 of the arm locking portion 156 of the actuation unit 150 may abut against the corresponding locking surface 183*a* of the locking tooth 183 of the first arm 120 so as to interlock the first locking hook 186 with the locking tooth 183 of the first arm 120, and the locking surface 189 of the second locking hook 188 of the arm locking portion 156 of the actuation unit 150 may abut against the corresponding locking surface 185*a* of the locking tooth 185 of the second arm 130 so as to interlock the second locking hook 188 with the locking tooth 185 of the second arm 130. Accordingly, when the first locking hook 186 of the arm locking portion 156 interlocks with the locking tooth 183 of the first arm 120, the locking surface 187 of the first locking hook 186 of the arm locking portion 156 may be in contact with the corresponding locking surface 183*a* of the locking tooth 183 of the first arm 120 to block the locking tooth 183 of the first arm 120 so as to obstruct the first arm 120 from rotating about the first rotational axis 121. Similarly, when the second locking hook 188 of the arm locking portion 156 interlocks with the locking tooth 185 of the second arm 130, the locking surface 189 of the second locking hook 188 of the arm locking portion 156 may be in contact with the corresponding locking surface 185*a* of the locking tooth 185 of the second arm 130 to block the locking tooth 185 of the second arm 130 so as to obstruct the second arm 130 from rotating about the second rotational axis 131.

According to various embodiments, the user-actuable portion 152, the arm actuation portion 154, and the arm locking portion 156 of the actuation unit 150 may be arranged in series along the extension axis 151 to form the actuation unit 150. When the actuation unit 150 is in the form of the elongated structure, the user-actuable portion 152 may be at the first longitudinal end portion of the elongated structure, the arm actuation portion 154 may be at the mid-portion of the elongated structure, and the arm locking portion 156 may be at the second longitudinal portion of the elongated structure. Accordingly, the actuation unit 150 may include the user-actuable portion 152, the arm actuation portion 154, and the arm locking portion 156 sequentially disposed along the extension axis 151. For example, the user-actuable portion 152, the arm actuation portion 154, and the arm locking portion 156 may be separate pieces stacked together along the extension axis 151 in the order of the user-actuable portion 152, followed by the arm actuation portion 154, and followed by the arm locking portion 156 to form the actuation unit 150. As another example, the actuation unit 150 may be an integral structure with the user-actuable portion 152, the arm actuation portion 154, and the arm locking portion 156 ordered in the manner of the user-actuable portion 152, followed by the arm actuation portion 154, and followed by the arm locking portion 156 along the extension axis 151. According to various embodiments, the actuation unit 150 may be disposed relative to the hub 110 such that the arm locking portion 156 of the actuation unit 150 may be proximal to the hanging hook 140 and the user-actuable portion 152 may be distal from the hanging hook 140. Accordingly, the actuation unit 150 may be disposed and orientated relative to the hub 110 such that the arm locking portion 156 of the actuation unit 150 may be situated closest to the hanging hook 140 while the user-actuable portion 152 may be farthest from the hanging hook 140. In other words, the actuation unit 150 may be oriented with the arm locking portion 156 of the actuation unit 150 directed or pointed towards the hanging hook 140 and with the user-actuable portion 152 of the actuation unit 150 directed away from the hanging hook 140.

Further, the arm actuation portion 154 of the actuation unit 150 may be between the arm locking portion 156 and the user-actuable portion 152.

According to various embodiments, the hanging hook 140 may be integrally formed with the hub 110. For example, the hanging hook 140 may be integrally molded or integrally printed with the hub 110. Accordingly, the hanging hook 140 may be fixed to the hub 110 and non-movable relative to the hub 110.

According to some embodiments, the hanging hook 140 may be coupled or joined to the hub 110 in a manner so as to be rotatable relative to the hub 110 about the extension axis 151 of the actuation unit 150 and non-movable relative to the hub 110 along the extension axis 151 of the actuation unit 150. Accordingly, the hanging hook 140 may swivel relative to the hub 110.

According to various embodiments, the hub 110 may include a side wall 112. The side wall 112 may include an internal wall surface 114. The internal wall surface 114 of the side wall 112 may be directed inwards of the hub 110. Accordingly, the internal wall surface 114 of the side wall 112 may be facing the interior space of the hub 110. According to various embodiments, the hanging hook 140 may be extending from the side wall 112 of the hub 110. According to various embodiments, the biasing member 160 may be disposed between the internal wall surface 114 of the hub 110 and the actuation unit 150. According to various embodiments, the biasing member 160 may be operatively connected to the internal wall surface 114 of the hub 110 and the actuation unit 150 so as to bias the actuation unit 150 relative to the internal wall surface 114 of the hub 110. Accordingly, the biasing member 160 may bias the actuation unit 150 away from the internal wall surface 114 of the hub 110 such that the actuation unit 150 may be biased towards the extended position along the extension axis 151. When the actuation unit 150 is moved towards the internal wall surface 114 of the hub 110 along the extension axis 151 (i.e. towards the retracted position), the biasing member 160 may provide the biasing force to the actuation unit 150 such that upon removal of the force that moved the actuation unit 150 towards the internal wall surface 114 of the hub 110, the biasing force of the biasing member 160 may urge the actuation unit 150 to move towards the extended position and away from the internal wall surface 114 of the hub 110.

According to various embodiments, the hub 110 may include a protrusion 168 protruding from the internal wall surface 114 of the side wall 112 of the hub 110. The protrusion 168 may engage with the biasing member 160 so as to keep or retain the biasing member 160 in place.

According to various embodiments, the biasing member 160 may be pre-loaded such that the biasing member 160 may bias the actuation unit 150 away from the internal wall surface 114 of the hub 110 towards the extended position. Accordingly, the biasing member 160 may keep or maintain the actuation unit 150 at the extended position when there are no other forces acting on the actuation unit 150. Hence, to move the actuation unit 150 towards the retracted position, an external force has to be applied on the actuation unit 150 whereby the external force has to be larger than the pre-loading of the biasing member 160. According to various embodiments, the biasing member 160 may be disposed and oriented such that the biasing force of the biasing member 160 may be in a direction parallel to or coinciding with the extension axis 151 of the actuation unit 150.

According to various embodiments, the biasing member 160 may include a compression spring 162. A first end 164 of the compression spring 162 may abut against the internal wall surface 114 of the hub 110 and a second end 166 of the compression spring 164 may abut against the actuation unit 150. Accordingly, the compression spring 162 may have the tendency to urge or push the actuation unit 150 away from the internal wall surface 114 of the hub 110. When the actuation unit 150 is moved towards the internal wall surface 114 of the hub 110 along the extension axis 151 (i.e. towards the retracted position), the compression spring 162 may provide the biasing force to the actuation unit 150 such that upon removal of the force that moved the actuation unit 150 towards the internal wall surface 114 of the hub 110, the biasing force of the compression spring 162 may urge the actuation unit 150 to move towards the extended position and away from the internal wall surface 114 of the hub 110.

According to various embodiments, the compression spring 162 may be pre-compressed such that the compression spring 162 may push or urge the actuation unit 150 away from the internal wall surface 114 of the hub 110 to keep or maintain the actuation unit 150 at the extended position when there are no other forces acting on the actuation unit 150. Hence, to move the actuation unit 150 from the extended position towards the retracted position, an external force has to be applied on the actuation unit 150 against the biasing force whereby the external force has to be larger than the biasing force provided by the pre-compression of the compression spring 162.

According to various embodiments, the hub 110 of the foldable clothes hanger may include a guide arrangement 190 to guide the actuation unit 150 to move along the extension axis 151 of the actuation unit 150. The guide arrangement 190 may be configured to constrain the actuation unit 150 to move linearly along the extension axis 151 of the actuation unit 150. Referring to FIG. 3, the guide arrangement 190 may include one or more guide ribs 192. Other than the guide ribs 192 as shown, it is understood that the guide arrangement 190 may also be a guide rail or a guide track or other suitable guide elements. According to various embodiments, as also shown, the actuation unit 150 may include a corresponding groove 194 to engage the guide arrangement 190 (e.g. the guide rib 192). Other than the corresponding groove 194 as shown, it is understood that the actuation unit 150 may include a corresponding notch or protrusion or other suitable elements for engaging with the guide arrangement 190 such that the actuation unit 150 may move along the extension axis 151 of the actuation unit 150.

Also shown in FIG. 3, according to various embodiments, the guide arrangement 190 of the hub 110 may also include a pair of guide walls 196 to guide the user-actuable portion 152 of the actuation unit 150 for extending out from the hub 110 and retracting back into the hub 110. Accordingly, the pair of guide walls 196 may be parallel to the extension axis 151 of the actuation unit 150. Further, the pair of guide walls 196 may be parallel to each other. According to various embodiments, the pair of guide walls 196 may be spaced apart with a distance configured for clearance fit with the user-actuable portion 152 of the actuation unit 150.

According to various embodiments, the hub 110 may include a stopper arrangement 198 to limit the first arm 120 and the second arm 130 when the first arm 120 and the second arm 130 are rotated away from each other in to the opened state. The stopper arrangement 198 may be an edge 112*a*, 112*b* of the side wall 112. According to various embodiments, the stopper arrangement 198 may be two opposite edges 112*a*, 112*b* of the side wall 112. The two opposite edges 112*a*, 112*b* of the side wall 112 may block the first arm 120 and the second arm 130 so as to prevent the first arm 120 and the second arm 130 from further rotating after reaching the opened state. Hence, the two opposite edges 112*a*, 112*b* of the side wall 112 may limit the rotation of the first arm 120 and the second arm 130.

As shown, according to various embodiments, the hub 110 may be of the flat cylinder shape. It is understood that the hub 110 may also be in other suitable shape including, but not limited to, a cuboid, a prism, an ovoid, a sphere, or a hemisphere. When the hub 110 is of the flat cylinder shape as shown, the side wall 112 may extend along a segment of the circumference (or perimeter) of the flat cylinder shape. Accordingly, the side wall 112 may be a curved wall or an arc wall or an arcuate wall aligned along the segment of the circumference (or perimeter) of the hub 110. According to various embodiments, the hub 110 may include a main part 116 having a base panel 116*a* and the side wall 112. The base panel 116*a* may be of a circular shape when the hub is of the flat cylinder shape. Further, the hub 110 may include a cover part 118 that may be coupled to the main part 116. The cover part 118 may be of a circular shape when the hub is of the flat cylinder shape. According to some embodiments, the cover part 118 may be coupled to the main part 116 via suitable fastening methods, including but not limited to snap-fitting etc., to the side wall 112. According to various embodiments, the one or more guide ribs 192 of the guide arrangement 190 and the pair of guide walls 196 of the guide arrangement 190 may be disposed at the base panel 116*a* of the main part 116 (e.g. an internal facing surface of the base panel 116*a*). Further, the main part 116 may include a pair of pins 116*b*, 116*c* disposed at the base panel 116*a* (e.g. the internal facing surface of the base panel 116*a*). The first rotational axis 121 and the second rotational axis 131 may be respectively extending through the pair of pins 116*b*, 116*c*. The first arm 120 may include a hole 124 at the longitudinal end portion 122, wherein the first arm 120 may be fitted to the main part 116 with the pin 116*b* inserted into the hole 124 in a manner such that the first arm 120 may be rotatable about the pin 116*b*. Similarly, the second arm 130 may include a hole 134 at the longitudinal end portion 132, wherein the second arm 130 may be fitted to the main part 116 with the pin 116*c* inserted into the hole 134 in a manner such that the second arm 130 may be rotatable about the pin 116*c*.

Figure 6:
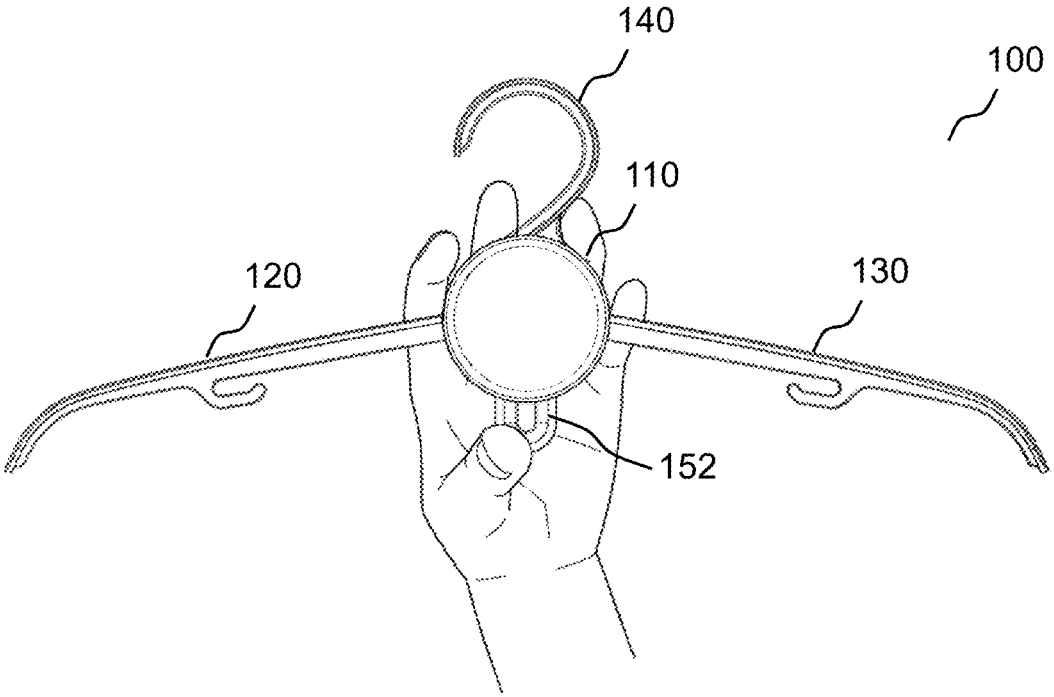
FIG. 6 and FIG. 7 show an example of a single-handed operation of the foldable clothes hanger of FIG. 1 for folding from the opened state to the closed state according to various embodiments.
Figure 7:
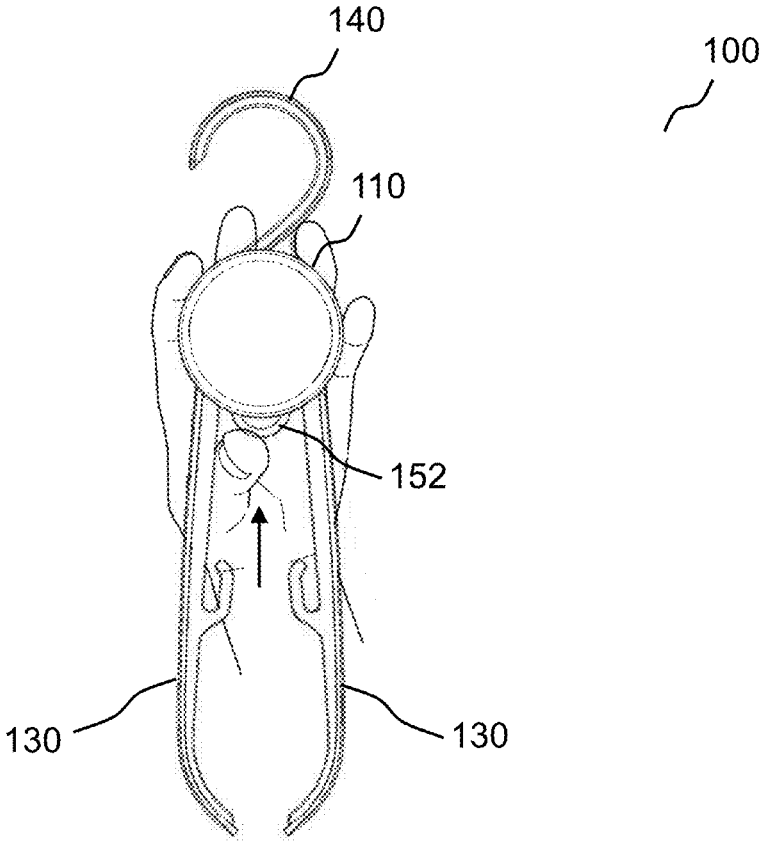

FIG. 6 and FIG. 7 show an example of a single-handed operation of the foldable clothes hanger 100 for folding from the opened state to the closed state according to various embodiments. As shown, the configuration of the foldable clothes hanger 100 may allow the user to hold the foldable clothes hanger 100 in one hand. Further, the user may easily fold the foldable clothes hanger 100 by simply depressing the user-actuable portion 152 of the actuation unit 150 into the hub 110 so as to rotate the first arm 120 and the second arm 130 from the opened state to the closed state. While FIG. 6 and FIG. 7 show that the user may use the thumb to depress the user-actuable portion 152 of the actuation unit 150, it is also possible to hold the foldable clothes hanger 100 from the opposite direction such that the middle finger and/or the index finger may be used to depress the user-actuable portion 152 of the actuation unit 150 into the hub 110.

Various embodiments have provided a foldable clothes hanger capable of being folded single-handedly from an opened state into a closed state such that a user may hold the clothing in one hand and the foldable clothes hanger in the other hand when inserting the foldable clothes hanger into the clothing for hanging the clothing. Various embodiments have also provided a foldable clothes hanger ergonomically configured for holding in a palm of the user's hand and capable of being folded via simple closing of fingers together. In the various embodiments, the foldable clothes hanger may be inserted through a neck line of the clothing without damaging the neck line.

While the invention has been particularly shown and described with reference to specific embodiments, it should be understood by those skilled in the art that various changes, modification, variation in form and detail may be made therein without departing from the scope of the invention as defined by the appended claims. The scope of the invention is thus indicated by the appended claims and all changes which come within the meaning and range of equivalency of the claims are therefore intended to be embraced.

The invention claimed is:

1. A foldable clothes hanger, comprising a hub;

a first arm rotatably coupled to the hub, the first arm being rotatable about a first rotational axis;

a second arm rotatably coupled to the hub, the second arm being rotatable about a second rotational axis, wherein the first rotational axis and the second rotational axis are parallel to each other;

an actuation unit retractably movable with respect to the hub between a retracted position and an extended position along an extension axis lying in a plane perpendicular to the first rotational axis and the second rotational axis, a hanging hook extending from the hub, the hanging hook being non-movable relative to the hub along the extension axis of the actuation unit; and a biasing member disposed to bias the actuation unit towards the extended position, wherein the actuation unit comprises a user-actuable portion extended out from the hub when the actuation unit is in the extended position and retractable into the hub when an external force is applied on the user-actuable portion against a biasing force of the biasing member to move the actuation unit to the retracted position, wherein the actuation unit is operatively engaged to the first arm and the second arm to drive and rotate the first arm and the second arm away from each other into an opened state when the actuation unit is moved from the retracted position to the extended position by the biasing force of the biasing member, and to drive and rotate the first arm and the second arm towards each other into the closed state when the actuation unit is moved from the extended position to the retracted position.

2. The foldable clothes hanger as claimed in claim 1, wherein, when the actuation unit is in the extended position with the user-actuable portion of the actuation unit extended out of the hub, the user-actuable portion of the actuation unit and the hanging hook are respectively at opposite sides of the hub.

3. The foldable clothes hanger as claimed in claim 1, wherein the actuation unit is moved towards the hanging hook when the actuation unit is moved from the extended position to the retracted position and moved away from the hanging hook when the actuation unit is moved from the retracted position to the extended position.

4. The foldable clothes hanger as claimed in claim 1, wherein the actuation unit comprises an arm actuation portion having an engagement arrangement in engagement with a corresponding engagement arrangement at a longitudinal end portion of the first arm and a corresponding engagement arrangement at a longitudinal end portion of the second arm, wherein the first rotational axis extends through the longitudinal end portion of the first arm, wherein the second rotational axis extends through the longitudinal end portion of the second arm, wherein the engagement converts a linear motion of the arm actuation portion of the actuation unit along the extension axis into rotating motions of the first arm and the second arm about the first rotational axis and the second rotational axis respectively.

5. The foldable clothes hanger as claimed in claim 4, wherein the engagement between the engagement arrangement of the arm actuation portion of the actuation unit and the corresponding engagement arrangements respectively at the longitudinal end portion of the first arm and the longitudinal end portion of the second arm is a rack and pinion type engagement.

6. The foldable clothes hanger as claimed in claim 5, wherein the engagement arrangement of the arm actuation portion of the actuation unit comprises a first row of teeth and a second row of teeth, each row of the first row of teeth and the second row of teeth being parallel to the extension axis of the actuation unit, the teeth of the first row of teeth and the teeth of the second row of teeth extending in opposite directions away from each other, the corresponding engagement arrangement at each of the longitudinal end portion of the first arm and the longitudinal end portion of the second arm comprises a set of arcuately arranged teeth, and the set of arcuately arranged teeth at the longitudinal end portion of the first arm is in engagement with the first row of teeth of the arm actuation portion of the actuation unit, and the set of arcuately arranged teeth at the longitudinal end portion of the second arm is in engagement with the second row of teeth of the arm actuation portion of the actuation unit.

7. The foldable clothes hanger as claimed in claim 6, wherein each row of the first row of teeth and the second row of teeth of the arm actuation portion of the actuation unit comprises two teeth, wherein the set of arcuately arranged teeth at each of the longitudinal end portion of the first arm and the longitudinal end portion of the second arm comprises two teeth.

8. The foldable clothes hanger as claimed in claim 4, wherein the actuation unit comprises an arm locking portion having an interlocking arrangement interlockable with a corresponding interlocking arrangement at the longitudinal end portion of the first arm and a corresponding engagement arrangement at the longitudinal end portion of the second arm, wherein the arm locking portion of the actuation unit locks the first arm and the second arm in the opened state when the actuation unit is in the extended position, wherein the arm locking portion of the actuation unit unlocks the first arm and the second arm for rotating into the closed state when the actuation unit is moved from the extended position towards the retracted position.

9. The foldable clothes hanger as claimed in claim 8, wherein the interlocking arrangement of the arm locking portion of the actuation unit comprises a pair of locking hooks, wherein the corresponding interlocking arrangement at each of the longitudinal end portion of the first arm and the longitudinal end portion of the second arm comprises a locking tooth, wherein, when the arm locking portion of the actuation unit locks the first arm and the second arm, a first locking hook of the arm locking portion of the actuation unit interlocks with the locking tooth of the first arm and a second locking hook of the arm locking portion of the actuation unit interlocks with the locking tooth of the second arm.

10. The foldable clothes hanger as claimed in claim 9, wherein each of the pair of locking hooks of the arm locking portion of the actuation unit comprises a locking surface parallel to the extension axis of the actuation unit, wherein the locking tooth at each of the longitudinal end portion of the first arm and the longitudinal end portion of the second arm comprises a corresponding locking surface oriented parallel to the extension axis of the actuation unit when the first arm and the second arm are in the opened state.

11. The foldable clothes hanger as claimed in claim 10, wherein the locking surfaces of the pair of locking hooks of the arm locking portion of the actuation unit are facing one another.

12. The foldable clothes hanger as claimed in claim 8, wherein the user-actuable portion, the arm actuation portion, and the arm locking portion are arranged in series along the extension axis of the actuation unit, wherein the arm locking portion is proximal to the hanging hook and the user-actuable portion is distal from the hanging hook.

13. The foldable clothes hanger as claimed in claim 10, wherein, when the arm locking portion of the actuation unit locks the first arm and the second arm, the locking surface of the first locking hook of the arm locking portion of the actuation unit abuts against the corresponding locking surface of the locking tooth of the first arm so as to interlock the first locking hook with the locking tooth of the first arm, and the locking surface of the second locking hook of the arm locking portion of the actuation unit abuts against the corresponding locking surface of the locking tooth of the second arm so as to interlock the second locking hook with the locking tooth of the second arm.

14. The foldable clothes hanger as claimed in claim 1, wherein the hanging hook is integrally formed with the hub.

15. The foldable clothes hanger as claimed in claim 1, wherein the biasing member is disposed between an internal wall surface of the hub and the actuation unit, and preloaded to bias the actuation unit away from the internal wall surface of the hub such that the actuation unit is bias towards the extended position.

16. The foldable clothes hanger as claimed in claim 15, wherein the biasing member is a compression spring and the compression spring is pre-compressed to push the actuation unit away from the internal wall surface of the hub such that the actuation unit is bias towards the extended position.

17. The foldable clothes hanger as claimed in claim 1, wherein the hub comprises a guide arrangement to guide the actuation unit to move along the extension axis of the actuation unit.

18. The foldable clothes hanger as claimed in claim 17, wherein the guide arrangement of the hub comprises a guide track or a guide rail or a guide rib, wherein the actuation unit comprises a corresponding protrusion or a groove or a notch to engage the guide arrangement.

19. The foldable clothes hanger as claimed in claim 18, wherein the guide arrangement of the hub comprises a pair of parallel guide walls to guide the user-actuable portion of the actuation unit for extending out from the hub and retracting back into the hub.

20. The folder clothes hanger as claimed in claim 1, wherein the hub comprises a stopper arrangement to limit the first arm and the second arm when the first arm and the second arm are rotated away from each other into the opened state.

* * * * *